US005586800A

United States Patent [19]

Triplett

[11] Patent Number: 5,586,800

[45] Date of Patent: Dec. 24, 1996

[54] HIGH CHAIR TRAY

[76] Inventor: Kelvin N. Triplett, 11304 E. 16th Ave., Spokane, Wash. 99206

[21] Appl. No.: 535,776

[22] Filed: Oct. 3, 1995

[51] Int. Cl.[6] ..... A47B 83/02

[52] U.S. Cl. ..... 297/148; 297/153; 297/188.01; 297/188.18; 108/26

[58] Field of Search ..... 297/134, 135, 297/148, 149, 150, 152, 153, 154, 188.01, 188.18, 188.2, 188.14; 108/25, 26; 206/564

[56] References Cited

U.S. PATENT DOCUMENTS

| | | | |
|---|---|---|---|
| 187,680 | 2/1877 | Taylor | 297/150 |
| 664,542 | 12/1900 | Firnhaber | 297/134 X |
| 2,008,689 | 7/1935 | Donahoe . | |
| 2,210,972 | 8/1940 | Christenson . | |
| 3,146,738 | 9/1964 | Telairco . | |
| 3,148,636 | 9/1964 | Bloomquist et al. . | |
| 3,475,052 | 10/1969 | Kaposi . | |
| 4,512,607 | 4/1985 | Rapp | 297/148 X |
| 4,606,576 | 8/1986 | Jones | 297/148 X |
| 4,927,024 | 5/1990 | Lloyd | 206/564 X |
| 5,010,826 | 4/1991 | Kudlace | 297/188.2 X |
| 5,232,190 | 8/1993 | Gould | 297/188.18 X |
| 5,437,493 | 8/1995 | Weisleder | 297/150 |

FOREIGN PATENT DOCUMENTS

| | | | |
|---|---|---|---|
| 472028 | 3/1951 | Canada | 297/153 |
| 527087 | 7/1956 | Canada | 297/135 |
| 1303627 | 8/1962 | France . | |
| 280896 | 12/1964 | Netherlands . | |

*Primary Examiner*—Laurie K. Cranmer
*Attorney, Agent, or Firm*—Richard C. Litman

[57] ABSTRACT

A high chair tray provides for the positive capture of food containers, e. g., bowls, dishes, etc., therein, to preclude tipping or spillage of the containers and/or their contents by an infant or small child in the high chair. The tray is separated into a forward and a rearward component by a lateral division, with the components connected by a left and a right track which allow the tray components to slide together and apart from one another. One or more depressions or receptacles are provided along the division, with the receptacle(s) each having an undercut channel. Specially formed containers are provided which nest in the receptacle(s) of the tray, with the containers each having a peripheral base flange extending therefrom. When the tray portions are separated, the container(s) may be placed within the appropriately fitting receptacle(s), with the container flange being captured by the undercut channel of the tray receptacle when the tray components are closed together. The tracks securing the tray components together may be internal or external, and different attachments to an underlying high chair may be provided. The tray components are preferably formed of plastic, with the cooperating containers preferably being formed of a material which is microwave safe.

9 Claims, 3 Drawing Sheets

HIGH CHAIR TRAY

FIELD OF THE INVENTION

The present invention relates generally to trays and the like for the feeding of infants and small children, and more specifically to a tray adapted for temporary installation to a high chair, and bowls, dishes, and the like therefor. The tray includes openable capture means for the bases of specially formed bowls and dishes, which capture means precludes their being tipped or spilled from the tray.

BACKGROUND OF THE INVENTION

The use of a high chair and tray for the feeding of infants and small children is well known, with such trays and chairs having been available for many years for children old enough to sit up and to eat solid or semi-solid food. Such high chairs and trays are a great convenience for parents or guardians of small children, as they compensate nicely for the small stature of such children and place a child using such a chair and tray, close to the level of the adults at the table for ease of caring for the child.

However, infants and small children are well known to spill dishes, bowls, and any food therein, from a table or tray, and parents and guardians almost universally accept the need to clean up not only the high chair tray, but also the surrounding area, after feeding a small child. Numerous devices have been developed in response to this nearly universal trait of infants and small children, e. g., liquid containers with covers and straws for drinking, but these are unsuitable for dispensing solid food.

Accordingly, a need will be seen for a specially formed high chair tray, and specially formed bowls, dishes, and the like which cooperate therewith, which tray positively captures such cooperating utensils to preclude their removal from the tray when the tray is closed to a utensil capturing position. Thus, an infant or small child cannot lift such a captured utensil from the tray to spill it on the tray or floor. Yet, the tray is easily opened to allow the removal of the utensils, and for cleanup of the tray components as required. Various means may be provided for securing and locking the tray components together, as well as for securing the tray to a high chair.

DESCRIPTION OF THE PRIOR ART

U.S. Pat. No. 2,008,689 issued to Michael A. Donahoe on Jul. 23, 1935 describes a Chair adapted for attachment to an existing conventional chair. A tray with a generally central hole therein is provided, but the hole merely provides for the placement of a nesting bowl therein, and does not positively capture the bowl; the bowl may still be lifted from the opening by means of its upper flange, or by pushing from below. While the Donahoe tray is adjustable fore and aft relative to the seat portion of the apparatus, the tray portion itself cannot be separated into different components, or closed together to lock a dish, bowl, or other like utensil therein, as provided by the present invention. The present invention is a tray which is adaptable to an existing high chair, or which alternatively may be provided in combination with a high chair, and does not include seating means and the other complexities of the Donahoe device.

U.S. Pat. No. 2,210,972 issued to Gust J. Christenson on Aug. 13, 1940 describes a Table Attachment comprising a plate which is set into the surface of an existing table. The table must be modified to allow the plate, and its receptacles, to fit substantially flush with the surface of the table. A cover plate is hinged to the plate to conceal the receptacles therein when they are not in use. The receptacles provide an ash tray and a holder for a drinking glass or the like, but neither of the receptacles are removable from the attachment, as are the food containers or dishes of the present tray. A drinking glass or the like placed therein may be lifted from the receptacle(s) as desired, and is not positively and immovably captured therein, as provided by the present tray. While one component is movable relative to the other, they are hinged together, rather than having a sliding relationship. Moreover, the device is permanently installed to the supporting table, and is not removable, as is the present tray.

U.S. Pat. No. 3,146,738 issued to George J. Telarico on Sep. 1, 1964 describes a Tray Adapted To Be Secured To A Chair For An Invalid. The tray includes a pair of rearwardly extending arms, with the arms hinged to fittings which clamp to a chair. The tray is of a single piece, and does not separate or divide in any manner for opening or for capturing any articles therein. While a plurality of relatively small recessed containers is provided along the forward edge of the tray, they are integrally formed with the tray and are not separable from the tray for cleaning, as provided by the containers used with the present tray. The only central feature of the Telarico tray is a mirror, as the Telarico tray is adapted for use with invalid adults or at least older children, rather than with infants and very small children.

U.S. Pat. No. 3,148,636 issued to George I. Bloomquist et al. on Sep. 15, 1964 describes a Serving Tray formed of a disposable material (heavy paper, etc.) and having a plurality of cutouts therein adapted to have various dishes, glassware, and/or other containers placed therein. An underlying bottom sheet is also provided, for such dishes and the like to rest upon. While Bloomquist et al. provide locking tabs at the peripheries of the various openings, these tabs merely serve to preclude lateral movement of containers placed within the cutouts, or possibly rotational movement of a specially formed container. Any of the containers may be lifted from the tray at any time, and are not positively captured therein by locking different components of the tray together, as provided by the present invention. Moreover, no means for attachment to a high chair or other structure is provided by Bloomquist et al.

U.S. Pat. No. 3,475,052 issued to George Kaposi on Oct. 28, 1969 describes a Portable Arm Chair Table, comprising a table portion having lateral hooks on each side thereof which hook into the arms of a chair adapted for the attachment of the table thereto. The central portion of the Kaposi table has a hinged upper leaf which may be propped up in the manner of an easel. This leaf does not provide for the positive capture of any other articles, however. Two round recesses are provided, one to each side of the central leaf, but again no means is provided to capture a drinking glass or other container positively within the recesses. The Kaposi tray does not separate forwardly and rearwardly about a lateral separation line, as provided by the present tray for the positive capture of specially adapted containers therein.

U.S. Pat. No. 4,606,576 issued to Richard O. Jones on Aug. 19, 1986 describes a Tray For A High Chair having an upper lattice adapted for the removable insertion of various articles (alphabet blocks, etc.) therein. The lattice may include a fixed bowl or depression therein, into which a removable bowl may be placed. However, the removable bowl is still easily displaced or removed from the tray, as no overlying flange or other means is provided to capture the removable bowl positively in the tray, as provided by the present invention. The Jones tray does not include any lateral separation means allowing the forward and rearward portions of the tray to be separated from one another, as provided by the present tray.

French Pat. Publication No. 1,303,627 to Rene Geiger and published on Aug. 6, 1962 describes a removable table for arm chairs, comprising a forwardly and rearwardly slidable table which is secured to the arms of the arm chair by means of a left and a right rod which slide into and from a corresponding tube installed to each arm of the chair. The table portion itself is a single, integral component, with no movable parts relative to one another, and does not provide any means of positively capturing any articles therein. A central depression is provided, along with a pair of laterally spaced passages, but these features cannot positively capture any articles therein.

Finally, Netherlands Pat. Publication No. 280,896 to Firma Albert Stultz and published on Dec. 10, 1964 describes a table for an electric cooking work station, wherein a container may be locked into the table by means of a pair of opposite latches. The latches are opened and closed by a single knob disposed to one side of the table. While FIG. 2 discloses this mechanism, it is a schematic figure with a portion of the table removed, and does not disclose any means of separating two portions of the table itself to lock and unlock a container(s) positively therein. Moreover, the present tray, with its fore and aft separation, is capable of positively locking or unlocking more than a single container therein simultaneously, whereas the linkage of the Netherlands patent publication disclosure is only capable of securing a single container within the table. Moreover, no means of attachment to another article is disclosed in the Netherlands patent publication.

None of the above noted patents, taken either singly or in combination, are seen to disclose the specific arrangement of concepts disclosed by the present invention.

SUMMARY OF THE INVENTION

By the present invention, an improved high chair tray is disclosed.

Accordingly, one of the objects of the present invention is to provide an improved high chair tray which is adapted to capture at least one specially formed bowl, dish, or the like, therein to preclude tipping of the bowl or dish, or spilling of food therefrom.

Another of the objects of the present invention is to provide an improved high chair tray which includes at least one depression therein having an undercut groove in the base thereof, with the depression and tray divided into separable forward and rearward components.

Yet another of the objects of the present invention is to provide an improved high chair tray which includes at least one container having a peripheral base flange, with the flange adapted to be captured within the undercut groove of the tray depression to capture the container positively within the tray when the tray portions are closed together.

Still another of the objects of the present invention is to provide an improved high chair tray which includes track means providing for the securing of the forward and rearward components of the tray together and for their separation as desired, which tracks may be either internal or external to the tray portions.

A further object of the present invention is to provide an improved high chair tray which includes locking means providing for securing the two tray portions together, and further means for securing the tray to an underlying high chair or the like.

An additional object of the present invention is to provide an improved high chair tray which at least one component thereof includes an underlying base providing support for containers placed thereon.

Another object of the present invention is to provide an improved high chair tray which may be formed of plastic or other materials as desired, and which containers are formed of materials suitable for use in microwave ovens.

A final object of the present invention is to provide an improved high chair tray for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the several figures of the attached drawings.

DETAILED DESCRIPTION OF THE PREFERRED EMBODIMENTS

Figure 1:
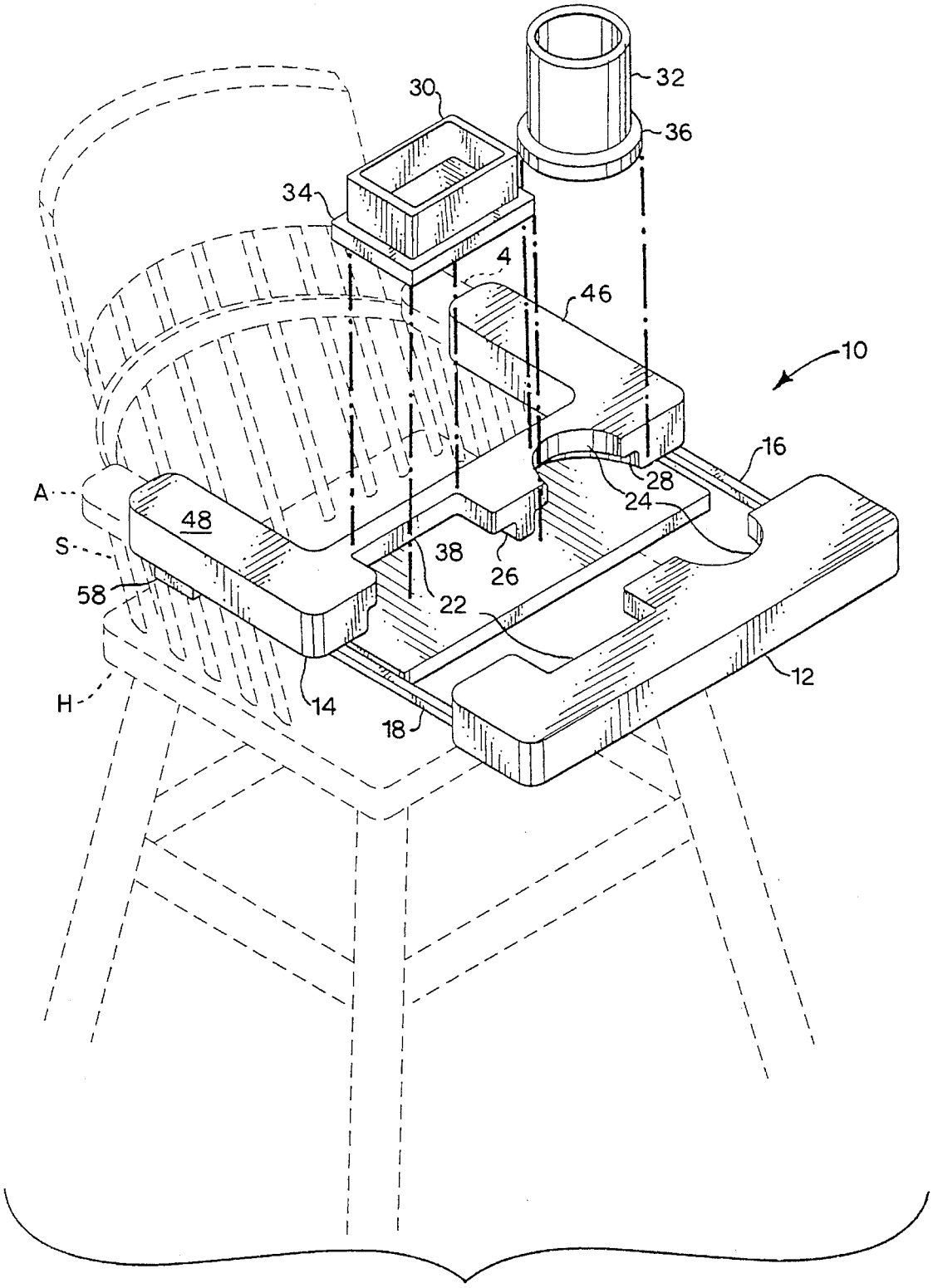
FIG. 1 is a top perspective view of the present high chair tray in its opened configuration, showing the removable insertion of the specially adapted containers therein.

Referring now particularly to FIG. 1 of the drawings, the present invention will be seen to relate to a high chair tray 10, which is adaptable to removable attachment to a high chair H. The tray 10 provides for the positive capture and securing of a specially configured bowl, dish, or the like therein (generally called "containers" hereinafter) to preclude their being tipped, spilled, overturned, or removed from the tray 10 by an infant or small child seated in the high chair H while eating.

The high chair tray 10 generally comprises a forward tray component 12 and a rearward tray component 14, which components 12 and 14 are slidably connected together by means of a left and a right track member 16 and 18. The two tray components 12 and 14 are coplanar, and separate along a lateral separation line 20, more clearly shown in FIG. 3. The tray 10 includes at least one (and preferably at least two) receptacle(s) therein, which are adapted for the positive retention of specially adapted containers therein, when the tray components 12 and 14 are closed together. In the embodiment shown in the drawing figures, a generally rectangular receptacle 22 and a generally round receptacle 24 are shown, but it will be understood that additional receptacles of virtually any shape planform may be provided as desired.

The two receptacles 22 and 24 are positioned along the lateral separation line 20, and hence each receptacle 22/24 is divided essentially into two equal halves when the tray components 12 and 14 are separated, as shown in FIG. 1. Each receptacle 22/24 includes an undercut channel, respectively 26 and 28, below the relatively narrower rim. These channels 26/28 are adapted to capture the containers 30 and 32 respectively within the receptacles 22/24, by means of the peripheral flanges, respectively 34 and 36, which extend from the base of each of the open container 30 and 32. Thus, when a container or containers 30/32 is/are placed respectively within the appropriate receptacle(s) 22/24 and the two tray components 12/14 are closed together, the container flange(s) is/are captured within the undercut channel(s) 26/28 of the receptacle(s) 22/24, and cannot be lifted or removed therefrom so long as the tray components 12/14 are closed together, thereby precluding the lifting or tipping of the container(s) 30/32.

Additional convenience in the placement of the container(s) 30/32 within the opened tray assembly 10 may be provided by an underlying plate 38, which plate 38 comprises a forward extension from the rear tray component 14. The plate 38 is positioned beneath the rear portion(s) of the receptacle(s) 22/24, and extends beneath their respective forward portion(s) when the tray components 12 and 14 are closed. Thus, a container(s) 30/32 rest upon the plate 38 after placement thereon and when the tray components 12 and 14 are closed, to prevent the container(s) 30/32 from falling through the receptacle(s) 22/24 or being removed from the tray 10 from below.

Figure 2:
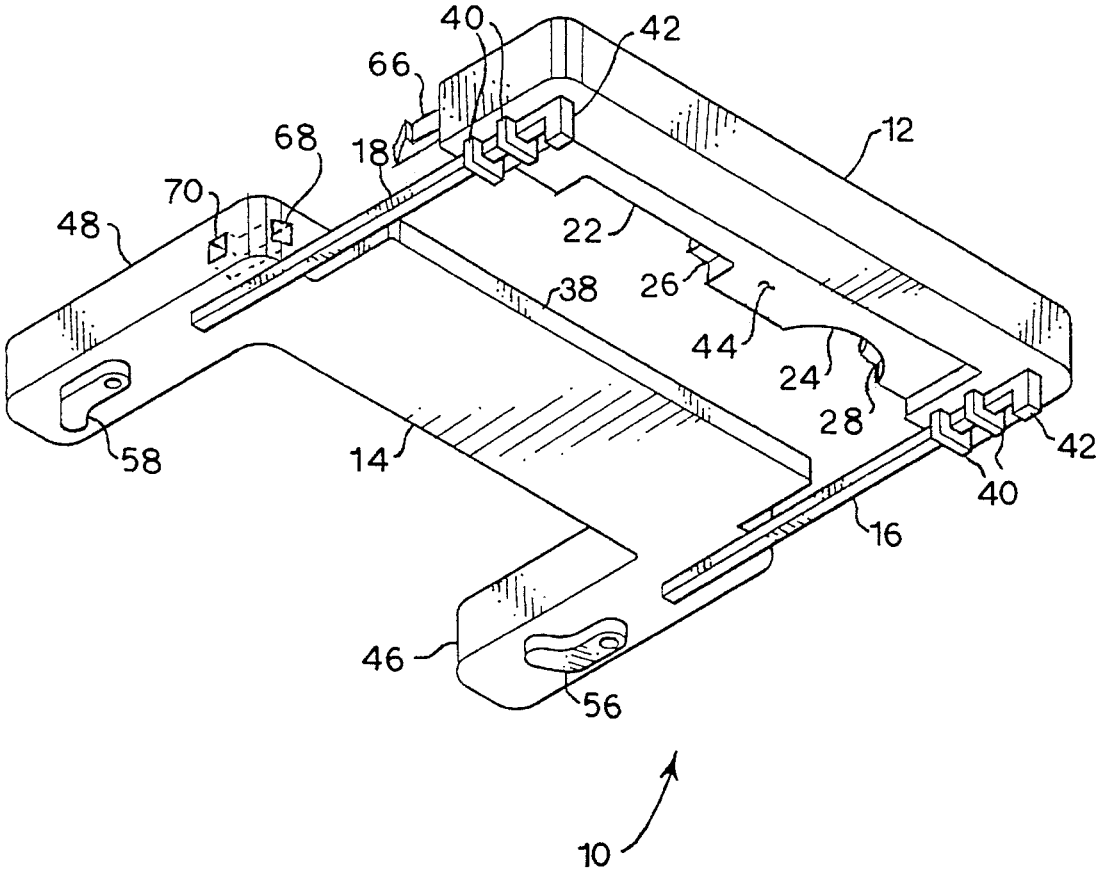
FIG. 2 is a bottom perspective view of the present high chair tray, showing further details of the capture means for the containers, the external tracks securing the two tray components together, and the latching means to secure the tray to the chair.

FIG. 2 provides a bottom perspective view of an embodiment of the present tray assembly 10, wherein the tracks 16 and 18 are disposed externally, beneath the tray components 12 and 14. The two tracks 16/18 are permanent components of the rearward tray component 14, and extend forwardly therefrom. They are captured beneath the forward tray component 12 by one or more guides 40. The assembly may be prevented from becoming disassembled by a retainer 42 at the distal or forwardmost end of each track 16 and 18. Thus, the forward tray component 12 may be separated from the rearward tray component 14, by pulling the forward component 12 away from the rearward component 14 along the tracks 16 and 18, with alignment assured by means of the guides 40 affixed to the underside of the forward tray component 12 and assembly of the two tray components 12 and 14 assured by means of the retainers 42 at the end of each track arm 16 and 18. A recess 44 may be provided in the underside of the forward tray component 12, to provide clearance for the underlying plate 38 extending forwardly from the rear tray component 14.

Figure 3:
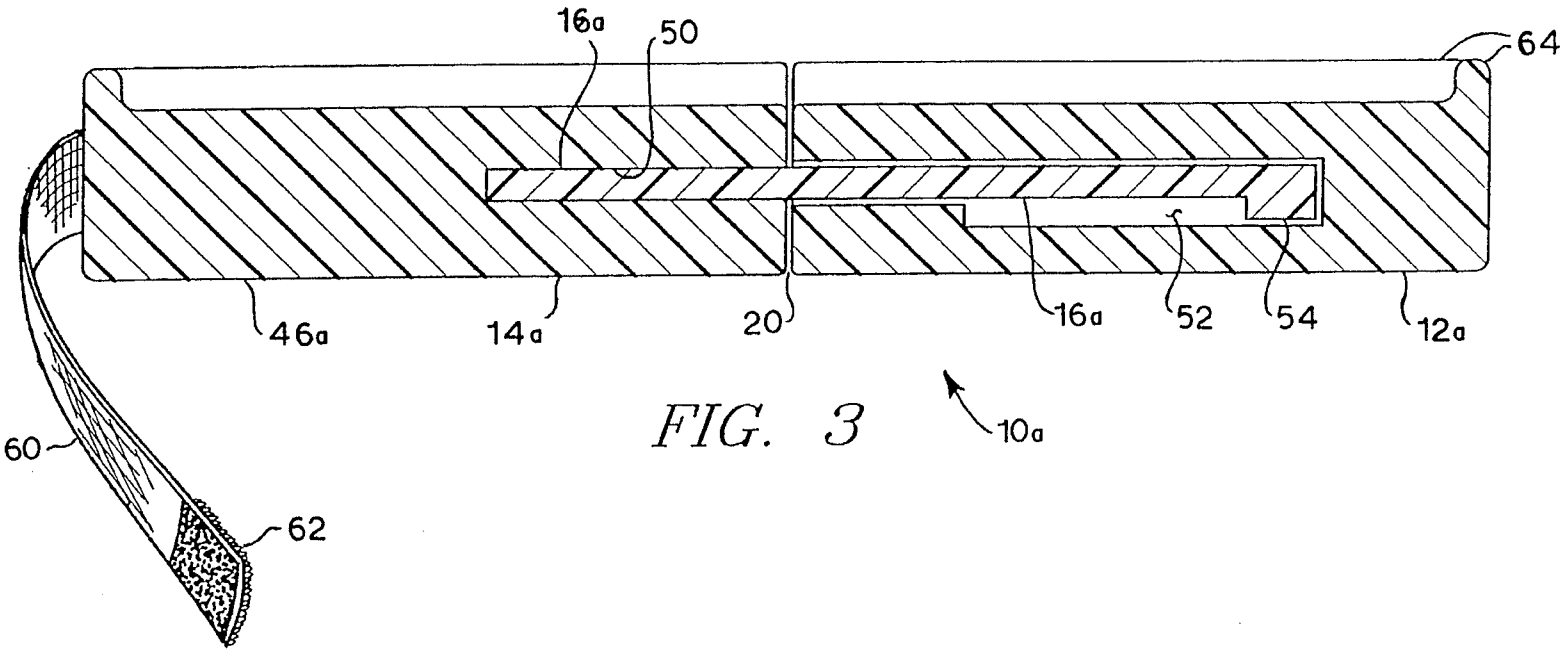
FIG. 3 is a side elevation view in section along one arm of an alternate embodiment of the tray, showing an internal track mechanism and chair attachment strap.

FIG. 3 shows a side elevation view in section, taken through an arm **46*a* of a tray 10*a*, of an alternate internal track embodiment. (Tray 10 of FIGS. 1 and 2 includes a left arm 46 and a right arm 48 extending rearwardly from the rear tray component 14, with the tracks 16 and 18 respectively aligned therealong.) A track 16*a* is immovably affixed within a socket 50 within the rear tray component 14*a*, with the track 16*a* and socket 50 extending rearwardly toward the interior of the arm 46*a*. (The track 16*a* may be formed integrally as a unitary component with the rear tray component 14*a*, if desired.) The track 16*a* extends forwardly into an internal track guide passage 52, formed within the lateral portion of the forward tray component 12*a*. As in the case of the external tracks described above, a retainer 54 may be formed in the forwardmost end of the track 16*a* during manufacture to preclude disassembly of the two tray components 12*a* and 14*a*, if desired. While the external tracks 16/18 of FIGS. 1 and 2 provide easier cleaning of the tray assembly 10, the internal tracks, e.g., track 16*a* of FIG. 3**, reduce the possibility of the external apparatus snagging the clothing or catching on some other object.

The present tray **10/10*a* may be secured to a high chair H or other object using some form of removable attachment means, such as the spring loaded latches 56 and 58 respectively extending below each arm 46 and 48 in FIG. 2. These latches 56/58 are biased toward one another, and are adapted to engage the arms A or supports S therefor. The present tray assembly 10 may be removed from the high chair H by pivoting the latches outward and sliding the assembly 10 forward, off the arms A of the chair H. A pair of straps 60 (one of which is shown in FIG. 3) and/or hook and loop fastening material 62**, or other means, may be used alternatively.

Figure 4:
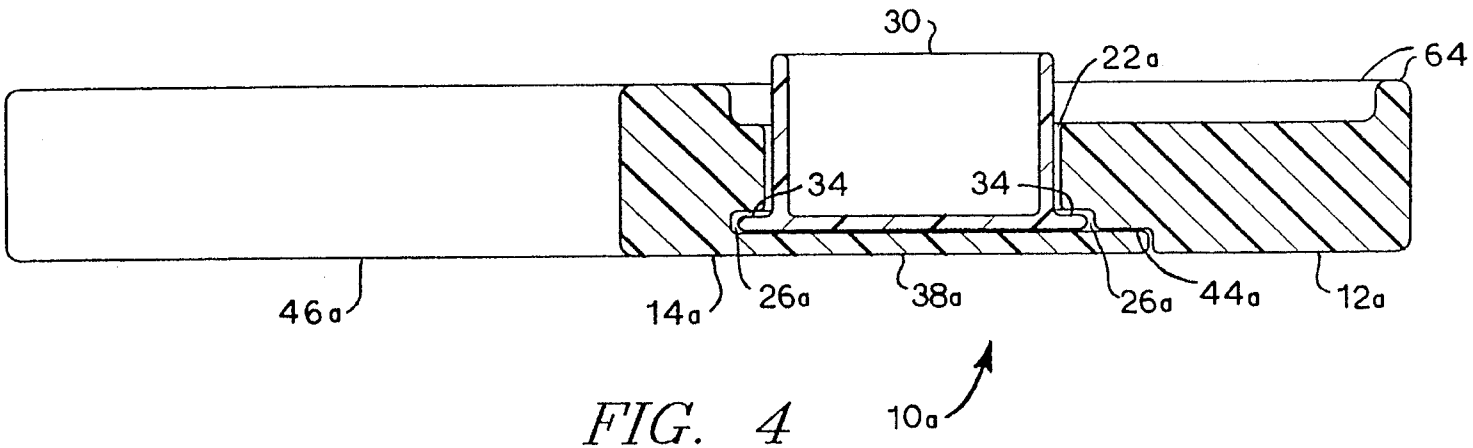
FIG. 4 is a side elevation view in section through the center of the tray, showing further details of the cooperating capture means between the tray and a specialized container therefor.

FIG. 4 provides a side elevation view in section through the center of the tray **10*a* of FIG. 3. (The strap means 60 is not shown, for clarity in the drawing figure.) Most of the components of the tray assembly 10*a* will be seen to be similar or identical to those corresponding components of the tray assembly 10 of figures i and 2, but tray 10*a* may include a raised peripheral ridge 64 therearound, to provide further containment of any spills which may occur, e. g., due to a spoonful of cereal or other fluid substance being spilled outside the captured container(s) 30. The tray 10*a* of FIG. 4 also discloses the capture means for a container captured therein, e. g., a container 30 with its outwardly extending peripheral base flange 34. The flange 34 is captured within an undercut channel 26*a* in the base of the receptacle 22*a*, with the container 30 being supported within the tray 10*a* by an underlying plate 38*a***.

In summary, the present tray in its various embodiments 10 and **10*a*, will be seen to provide a solution to the chronic problem of infants and small children who accidentally or purposely tip, spill, or otherwise displace a bowl, dish, or other container of food resting upon a high chair tray. The present tray 10/10*a* is adapted for ease of cleanup, as well as for positive capture and retention of specially adapted containers therein, with the tray 10/10*a*** preferably being formed of a plastic material of some sort. (Other materials may be used alternatively as desired.) The containers adapted for use with the present tray are also preferably formed of a plastic material for durability and impact resistance, but may also be formed of alternative materials. Preferably, the container material is compatible for use with microwave ovens, for quick heating of prepared foods.

The tray assembly **10/10*a* may be secured to a high chair H as described above, after the infant or child has been placed in the chair. When food has been prepared and/or heated as desired in a container 30/32, the two tray components 12/14 (or 12*a*/14*a*) may be separated, with the container being placed upon the underlying shelf or plate 38/38*a* of the rear tray portion 14/14*a* and within the appropriate receptacle, according to the configuration of the container. The forward tray component 12/12*a* is then slid rearwardly along the tracks to close the lateral separation 20 between the tray portions. A tray closure latch 66 (FIG. 1) may be provided to lock the two tray components together, with the latch extending rearwardly from the front tray component to engage a cooperating passage 68** in the rearward tray component.

Once the tray components have been placed together, the base flange(s) of any container(s) placed within the receptacle(s) of the tray preclude the container(s) from being lifted from the tray by the relatively narrow rim of the receptacle(s) which overly the undercut channel(s) into which the flange(s) of the container(s) fit. The container(s) cannot fall from the bottom of the tray, due to the underlying plate member upon which the container(s) is/are placed before the tray components are closed together.

When the child's meal is finished, the tray components may be unlocked by pressing the resilient latch member inward through the release passage 70 in the side of the rear tray component, and the latch withdrawn from the latch passage in the rear tray component and the forward tray component correspondingly withdrawn from the rearward component. The tray components, as well as the container(s) adapted for use therewith, may be cleaned as required (they may be washable in a dishwasher) and stored for later use.

It is to be understood that the present invention is not limited to the sole embodiments described above, but encompasses any and all embodiments within the scope of the following claims.

I claim:

1. A high chair tray, comprising:

a tray assembly having an top surface and a bottom surface, said tray assembly including a forward tray component and a rearward tray component divided by a lateral separation line, said forward tray component and said rearward tray component disposed in coplanar relationship;

a left and a right track member extending forwardly from said rearward tray component, said left track member and said right track member permanently and slidably secured to said forward tray component, said left track member and said right track member slidably connecting said forward tray component and said rearward tray component together;

at least one container receptacle included in said tray assembly and divided substantially equally said lateral separation line, said at least one receptacle including a rim protruding from said top surface of said tray assembly around said at least one container receptacle;

a plate underlying said bottom surface of said tray assembly, said plate extending from said rearward tray component forwardly under said at least one container receptacle, said plate and said rim defining a peripheral channel surrounding said at least one container receptacle, whereby;

at least one container including flanges adapted to be positively secured within said at least one container receptacle placed on said plate is securable to said tray assembly by slidably closing said forward and rearward tray components together along said left and right track members to secure the container positively within said tray assembly by said peripheral channel surrounding said at least one container receptacle.

2. The high chair tray of claim 1, wherein:

said rearward tray component includes a left arm and a right arm extending rearwardly, therefrom, with each said arm substantially in alignment respectively with said left and said right track member.

3. The high chair tray of claim 1, wherein:

said left and said right track member are each disposed externally below said tray assembly.

4. The high chair tray of claim 1, wherein:

said left and said right track member are each disposed internally within said tray assembly.

5. The high chair tray of claim 1, including:

means providing for the locking of said forward and said rearward tray component together as a closed tray assembly.

6. The high chair tray of claim 1, including:

means providing for the removable attachment of said tray assembly to a high chair.

7. The high chair tray of claim 6, wherein:

said rearward tray component includes a left arm and a right arm extending rearwardly therefrom, and said removable attachment means comprises a left and a right latch disposed respectively below said left arm and said right arm with each said latch being adapted to secure said tray assembly removably to a high chair.

8. The high chair tray of claim 7, wherein:

said rearward tray component includes a left arm and a right arm extending rearwardly therefrom, and said removable attachment means comprises a left and a right strap disposed respectively rearwardly from said left arm and said right arm with each said strap being adapted to secure said tray assembly removably to a high chair.

9. The high chair tray of claim 1, wherein:

said tray assembly is formed of plastic material.

* * * * *